United States Patent [19]

Kobashi et al.

[11] Patent Number: 4,461,253

[45] Date of Patent: Jul. 24, 1984

[54] METHOD OF CONTROLLING THE IDLE ROTATIONAL SPEED OF AN INTERNAL COMBUSTION ENGINE

[75] Inventors: Mamoru Kobashi, Aichi; Hiroshi Ito, Nagoya, both of Japan

[73] Assignee: Toyota Jidosha Kabushiki Kaisha, Toyota, Japan

[21] Appl. No.: 418,532

[22] Filed: Sep. 15, 1982

[30] Foreign Application Priority Data

Sep. 18, 1981 [JP] Japan ..... 56-146087

[51] Int. Cl.[3] ..... F02D 33/02

[52] U.S. Cl. ..... 123/339; 123/352

[58] Field of Search ..... 123/339, 352, 361, 585

[56] References Cited

U.S. PATENT DOCUMENTS 4,237,833 12/1980 Des Lauriers ..... 123/339

4,337,742 7/1982 Carlson et al. ..... 123/339

4,392,468 7/1983 Kobashi et al. ..... 123/339

*Primary Examiner*—Andrew M. Dolinar

*Attorney, Agent, or Firm*—Cushman, Darby & Cushman

[57] ABSTRACT

The idle air flow to an engine is increased or decreased in response to a control signal which is produced by comparing actual engine speed with a desired idle speed. Whether the above increase or decrease operation is continuously repeated more than a certain times is discriminated. If it is repeated more than the certain times, whether the variation of the engine speed during the above continuous increase or decrease operation is less than a predetermined value is discriminated. When the engine-speed variation during the above increase or decrease operation is less than the predetermined value, the idle speed control operation is inhibited from being executed.

5 Claims, 7 Drawing Figures

METHOD OF CONTROLLING THE IDLE ROTATIONAL SPEED OF AN INTERNAL COMBUSTION ENGINE

BACKGROUND OF THE INVENTION

The present invention relates to a method of controlling the idle speed of an internal combustion engine.

A known method of controlling the idle speed consists of controlling by closed-loop the opening degree of a throttle valve or the opening degree of a flow-control valve in a by-pass intake passage which is provided in parallel with an intake passage that accommodates the throttle valve, by using a valve-control motor, such as a step motor or a servo motor, depending upon the running speed when the engine is in the idling condition. According to this known idle-speed control method, the engine speed and a desired idle speed are compared with each other and the valve-control motor is adjusted to control the idle air flow depending upon the compared result so that the engine speed is converged by closed-loop to the desired idle speed.

The above-mentioned closed-loop idle speed control is executed only when the operating condition of the engine enters a predetermined idling condition. The predetermined idling condition is when the throttle valve is at the idle position and the running speed of the vehicle mounting the engine is nearly zero.

However, closed-loop idle speed control is sometimes carried out by mistake even if the operating condition is not the predetermined idling condition. In such a case, if the throttle valve suddenly returns to the fully closed position, the rotational speed of the engine abruptly decreases. In the worst case, the engine stalls.

For instance, during deceleration, if the vehicle speed sensor malfunctions and outputs an error signal which indicates the vehicle speed is zero, the closed-loop control system deems that the engine is in the predetermined idling condition and thus executes the idle speed control. In this case, since the engine speed is high, the idle opening degree of the throttle valve or the opening degree of the bypass flow-control valve is reduced. Therefore, if the transmission is shifted to the neutral position, the engine speed abruptly decreases, causing the engine to stall.

Furthermore, there occurs a problem if the throttle position switch is a type which produces an idle position signal even when the throttle valve opens by a certain extent and also if the vehicle speed is zero. In this case, the closed-loop idle speed control is executed to decrease the idle opening degree of the throttle valve or the opening degree of the bypass flow-control valve when the throttle valve gradually opens from its fully closed position. During such a state, if the throttle valve suddenly closes, since there is not sufficient idle air flow, the engine speed abruptly decreases, causing the engine to sometimes stall.

SUMMARY OF THE INVENTION

It is, therefore, an object of the present invention to provide a method of controlling the idle speed of an internal combustion engine, whereby abrupt decrease or change of the engine speed and also engine stall can be prevented from occurring even if a false predetermined idling condition is recognized and abnormal idle speed control is carried out.

The present invention relates to an idle rotational speed control method including the steps of: detecting the rotational speed of the engine to produce an engine-speed signal which is determined depending upon the detected engine speed; comparing the engine-speed signal with a reference signal which represents a desired idle speed of the engine to produce a control signal in accordance with the above comparison; increasing or decreasing the idle air flow to the engine in response to the control signal; and repeating the above sequence of steps so as to reduce the difference between the detected engine-speed and the desired idle speed. According to the present invention, the method comprises the steps of: discriminating whether or not the above increasing or decreasing step of idle air flow is continuously repeated more than predetermined number of times; if repeated more than the predetermined number of times, discriminating whether or not the variation of the engine speed during the repeated increasing or decreasing steps is less than a predetermined value; and if the engine-speed variation is less than the predetermined value, inhibiting the above control operation of the idle rotational speed from being executed.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
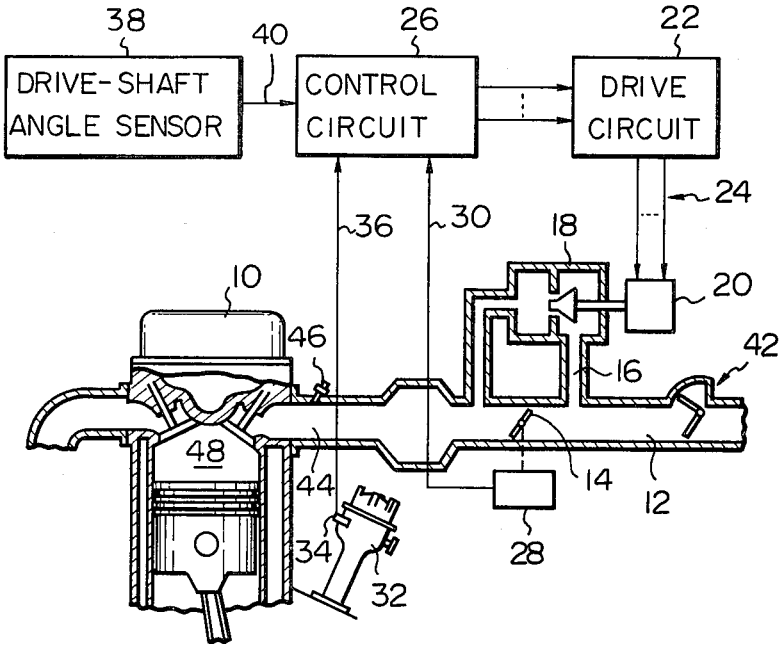
FIG. 1 is a schematic diagram illustrating an embodiment of the present invention.

FIG. 1 schematically illustrates a system for controlling the idle speed, which is applied to an electronically controlled fuel injection-type internal combustion engine according to an embodiment of the present invention. In FIG. 1, reference numeral 10 denotes an engine body, and 12 denotes an intake passage having a throttle valve 14. A control valve 18 is provided in a by-pass intake passage 16 which communicates the intake passage on the upstream side of the throttle valve 14 with the intake passage on the downstream side of the throttle valve 14, by-passing the throttle valve 14. The control valve 18 works to control the cross-sectional area of the passage 16. The opening and closing of the control valve 18 is controlled by a valve-control motor 20, such as step motor or d-c servo motor. The motor 20 is energized by an electric current which is supplied from a drive circuit 22 via lines 24. The drive circuit 22 is served with drive signals from a control circuit 26.

A throttle position switch 28 is mounted on the shaft of the throttle valve 14 to detect whether the throttle valve 14 is located at the idling position. The detection signal is sent to the control circuit 26 via a line 30.

A distributor of the engine is provided with a crank-angle sensor 34 which produces a crank angle pulse or a primary ignition pulse at every rotation of a predetermined crank angle. The crank angle pulses are sent to the control circuit 26 via a line 36.

A drive-shaft angle sensor 38 produces an angle pulse at every predetermined-angle rotation of a rotary shaft such as a drive shaft or a shaft for driving the speedometer which rotates a predetermined angle is proportion to the turn of a wheel of the vehicle on which the engine is mounted. The angle pulses from the sensor 38 are fed to the control circuit 26 via a line 40.

As is well known, in electronic control fuel injection-type internal combustion engines of this type, the flow rate of the intake air sucked into the engine is detected by an air-flow sensor 42 disposed in the intake passage 12, and fuel is supplied in an amount in accordance with the detected flow rate of the intake air into a combustion chamber 48 of the engine from a fuel injection valve 46 mounted in an intake manifold portion 44. Therefore, the rotational speed of the engine can be controlled by controlling the flow rate of intake air by the throttle valve 14 or the control valve 18.

Figure 2:
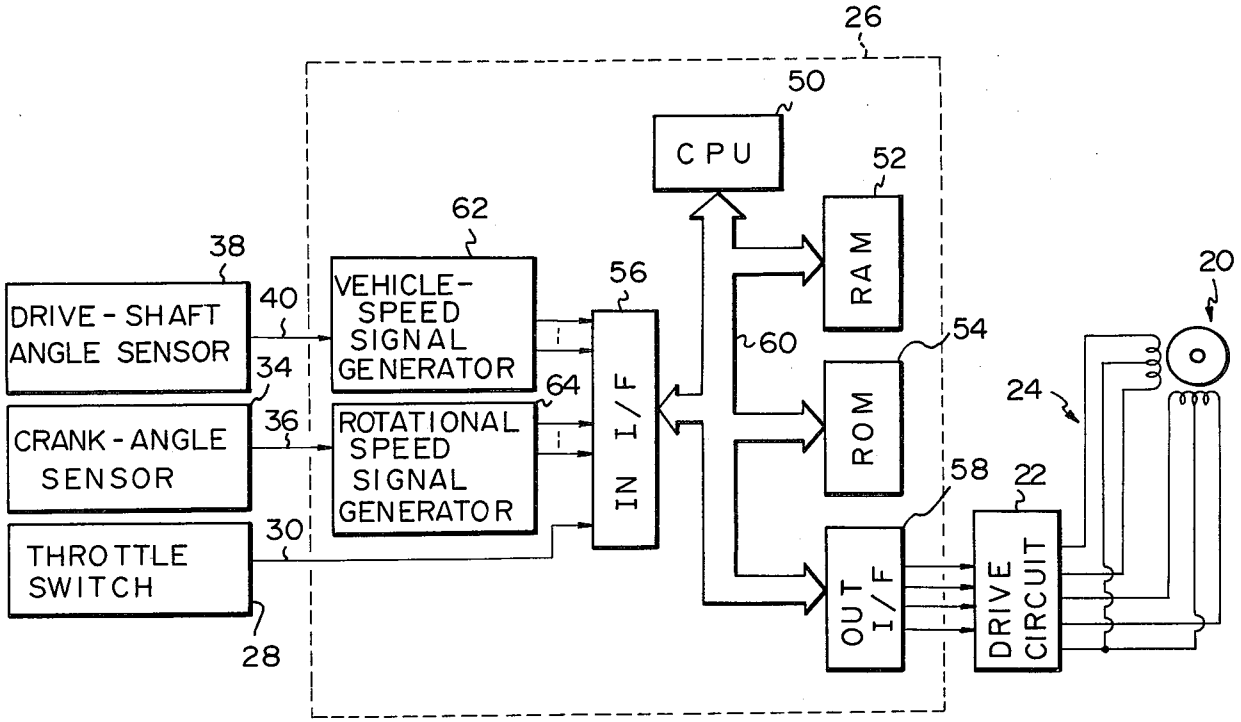
FIG. 2 is a block diagram illustrating an example of the control circuit of FIG. 1.

FIG. 2 is a block diagram illustrating an example of the control circuit 26 of FIG. 1. In this case, a digital computer of the stored program type is used in the control circuit 26. The digital computer consists of a central processing unit (CPU) 50 which executes a variety of calculations, a random access memory (RAM) 52 which is capable of the writing and reading operation of the data, a read-only memory (ROM) 54 in which have been stored beforehand control programs, calculation constants and various tables used for the calculations, an input interface 56, and an output interface 58, which are connected to each other via a bus 60.

The input interface 56 is served with binary vehicle-speed signals that represent the running speed of the vehicle fed from a vehicle-speed signal generator 62 which is made up of a conventional circuit for measuring, relying upon a counter or the like, and the time interval between the angle pulses from the drive-shaft angle sensor 38. The input interface is further served with binary rotational speed signals (engine speed signals) which represent the rotational speed of the engine fed from a rotational speed signal generator 64 which is made up of a conventional circuit for measuring, relying upon a counter or the like, and the time interval of the crank-angle pulses from the crank-angle sensor 34. The input interface 56 further receives a throttle switch signal of the level "1" or "0" which represents whether the throttle valve 14 is at the idling position or not, and which is produced by the throttle position switch 28. According to the embodiment of FIG. 2, the drive circuit 22 for driving the valve-control motor 20 which consists of a step motor is connected to the output interface 58. An electric current for exciting the step motor is produced by the drive circuit 22 responsive to a drive signal of four bits fed from the CPU 50 via the bus 60 and the output interface 58.

The operation of the embodiment will be illustrated below with reference to a flow chart shown in FIG. 3 which schematically represents the flow of an interrupt processing program for controlling the idling speed that is stored in the ROM 54.

Figure 3A:
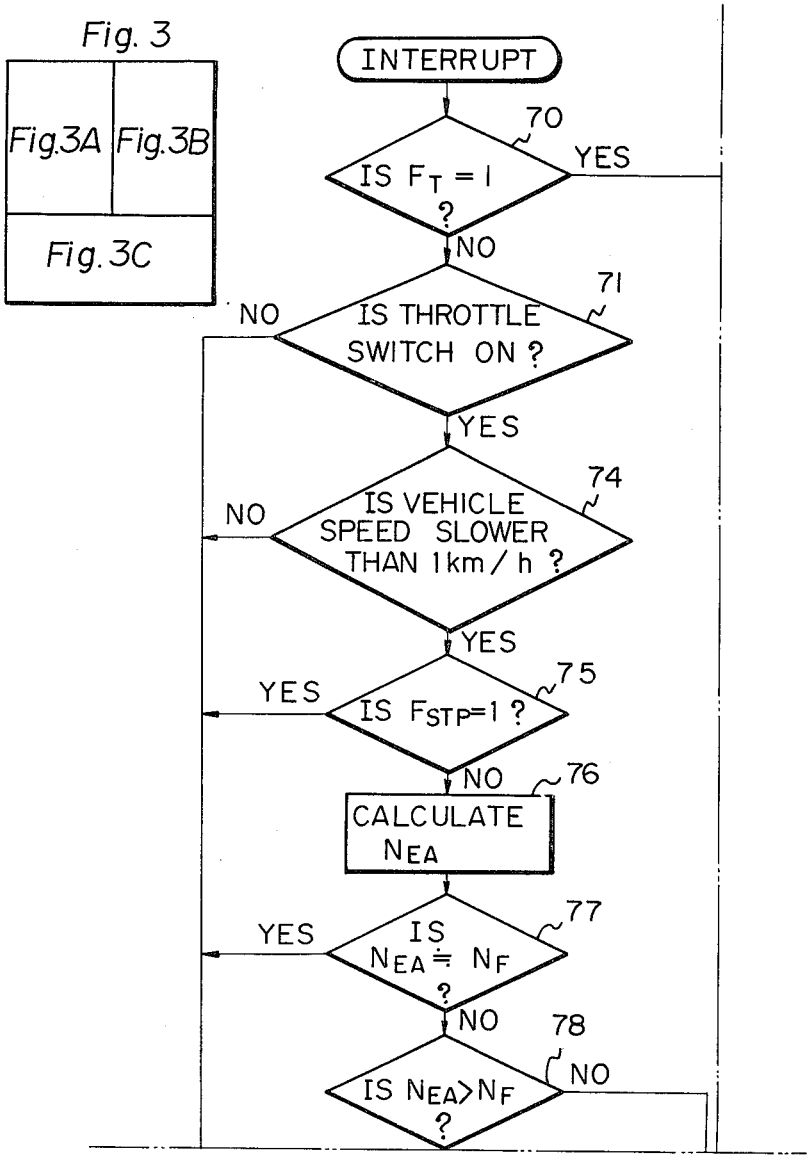
FIGS. 3A, 3B and 3C which constitute FIG. 3 are flow diagrams illustrating a control program of the embodiment of FIG. 1.

The CPU 50 executes the interrupt processing routine of FIG. 3 in response to an interrupt request which is produced at every 1.5 seconds. At a point 70 (FIG. 3A), the CPU 50 discriminates whether a timer flag $F_T$ is "1" or not. The timer flag $F_T$ is used to delay the detection of the engine speed for a period of T seconds after the valve-control motor 20 is driven, so as to stabilize the engine speed. The timer flag $F_T$ is at first reset to "0".

If $F_T=0$, the program proceeds to a point 71 where the CPU 50 discriminates whether the throttle switch signal from the throttle position switch 28 is "1" or "0". When the throttle switch signal is "1", i.e., when the throttle valve is not at the idling position, the program proceeds to points 72 and 73 (FIG. 3C). At the points 72 and 73, contents $C_U$ and $C_D$ in first and second counters, that will be used in a subsequent processing, are reset to "0". The interrupt processing routine of this time is thus finished, and the program returns to the main routine.

When it is so discriminated at the point 71 that the throttle switch signal is "0", i.e., when the throttle valve 14 is at the idling position, the program proceeds to a point 74 where it is discriminated, relying upon the vehicle-speed signal, whether the present vehicle speed is smaller than 1 km per hour or not. When the vehicle speed is equal to or greater than 1 km per hour, the program proceeds to the points 72 and 73. When it is so discriminated that the vehicle speed is smaller than 1 km per hour, the program proceeds a point 75 presuming that the engine is under the predetermined idling condition. Namely, according to this embodiment, the predetermined idling condition is established when the throttle valve is at the idling position and when the vehicle speed is smaller than 1 km per hour. In the above-mentioned embodiment, the digital signal having a value corresponding to the present vehicle speed is formed by the vehicle-speed signal generator circuit 62, and whether the signal represents the vehicle speed of smaller than 1 km per hour is discriminated by the CPU 50. However, the above discrimination may be effected in the vehicle-speed signal generator circuit 62, and a signal "1" or "0" which is the result of discrimination may be fed the CPU 50 via the input interface 56.

At the point 75, it is discriminated whether or not a stoppage flag $F_{STP}$ for inhibiting the idle speed control is "1". If $F_{STP}=1$, the process at the points 72 and 73 is carried out, and thereafter the interrupt processing routine of this time is finished. Namely, when $F_{STP}=1$, the idle speed control is not carried out even if the predetermined idling condition is established.

If $F_{STP}=0$, the program proceeds to a point 76 where the average value $N_{EA}$ of the engine speed for the past T seconds is calculated. The calculation of the average engine speed $N_{EA}$ at the point 76 may be executed by reading out the engine speed signals from the RAM 52 at intervals shorter than T seconds and by calculating the average value of the read engine speed signals, or executed by reading out the average engine speed signal from the RAM 52, which average engine speed signal was calculated beforehand and stored in the RAM 52.

Then, at a point 77, the CPU 50 discriminates whether or not the calculated average engine speed $N_{EA}$ is nearly equal to a predetermined desired value $N_F$ of the engine speed. If $N_{EA}$ is nearly equal to $N_F$, since it is not necessary for driving the valve-control motor 20, the program proceeds to the points 72 and 73. If the average speed $N_{EA}$ is different from the desired speed $N_F$, the program proceeds to a point 78 where it is discriminated whether or not the average speed $N_{EA}$ is greater than the desired speed $N_F$. If $N_{EA}>N_F$, the program proceeds to a point 79 (FIG. 3C) where the CPU 50 discriminates whether the content $C_D$ in the second counter is "0" or not. If $C_D=0$, the program proceeds to a point 80, and if $C_D\neq 0$, the program jumps to a point 81. That is, in case the valve-control motor 20 was not driven and the process at the point 73 was executed in the last interrupt processing, or in case the valve-control motor 20 was driven to open the valve in the last interrupt processing, since $C_D=0$, the program proceeds to the point 80. At the point 80, the average engine speed $N_{EA}$ calculated at the point 76 is stored in the RAM 52 as $N_M$. At the next point 81, the content $C_U$ in the first counter is reset to "0". Then, at a point 82, the content $C_D$ in the second counter is increased by "1". In other words, the content $C_D$ in the second counter indicates the repeating number of the continuously repeated operation of the branch from the point 79 to point 83. Once the operation of this branch is not executed, $C_D$ will be reset to "0".

At the point 83, a drive signal is fed to the output interface 58 so that the control valve 18 is driven toward the closing direction. In the embodiment of FIG. 2, if the valve control motor 20 is a step motor of the four-pole two-phase excitation type, the drive signal will take the form of any one of "1100", "0110", "0011" or "1001". If it is presumed that a drive signal corresponding to the present position of the step motor 20 takes the form "0110", the drive signal of, for example, "1100" should be produced to the output interface 58 at the point 81. The drive circuit 22 then generates an exciting current to the phase which corresponds to "1" of the drive signal. Therefore, the step motor 20 is turned by one step in a given direction, and the control valve 18 is actuated by a predetermined amount toward the direction to close the valve. Therefore, the flow rate of the intake air is reduced correspondingly, causing the rotational speed to decrease. If the step motor is turned by one step as aforementioned, the idle engine speed decreases by about 15 rpm during correct operating conditions.

Then, the program proceeds to a point 84 where the timer flag $F_T$ is inverted to "1". Thereafter, the interrupt processing routine of this time is finished.

On the other hand, if it is discriminated that the average speed $N_{EA}$ is not greater than the desired speed $N_F$ at the point 78 (FIG. 3A), the program proceeds to a point 85 (FIG. 3C). At the point 85, the CPU 50 discriminates whether the content $C_U$ in the first counter is "0" or not. If $C_U=0$, the program proceeds to a point 86 where the average speed $N_{EA}$ calculated at the point 76 is stored in the RAM 52 as $N_M$. If $C_U\neq 0$, the program directly proceeds to a point 87. That is, in case the valve-control motor 20 was not driven and the process at the point 72 was executed in the last interrupt processing, or in case the valve-control motor 20 was driven to close the valve in the last time interrupt processing, since $C_U=0$, the operation of $N_M \leftarrow N_{EA}$ is executed at the point 86. At the next point 87, the content $C_D$ in the second counter is reset to "0". Then, at a point 88, the content $C_U$ in the first counter is increased by "1". The content $C_U$ in the first counter indicates the repeating number of the continuously repeated operation of the branch from the point 85 to point 89.

At the next point 89, a drive signal is fed to the output interface 58 so that the control valve 18 is driven toward the opening direction. This means that a drive signal is produced in order to rotate the valve control motor 20 in the opposite direction. Therefore, the flow rate of the intake air sucked into the engine is increased causing the rotational speed to increase. If the step motor is turned by one step as mentioned above, the idle engine speed increases by about 15 rpm during correct operating conditions.

Figure 3B:
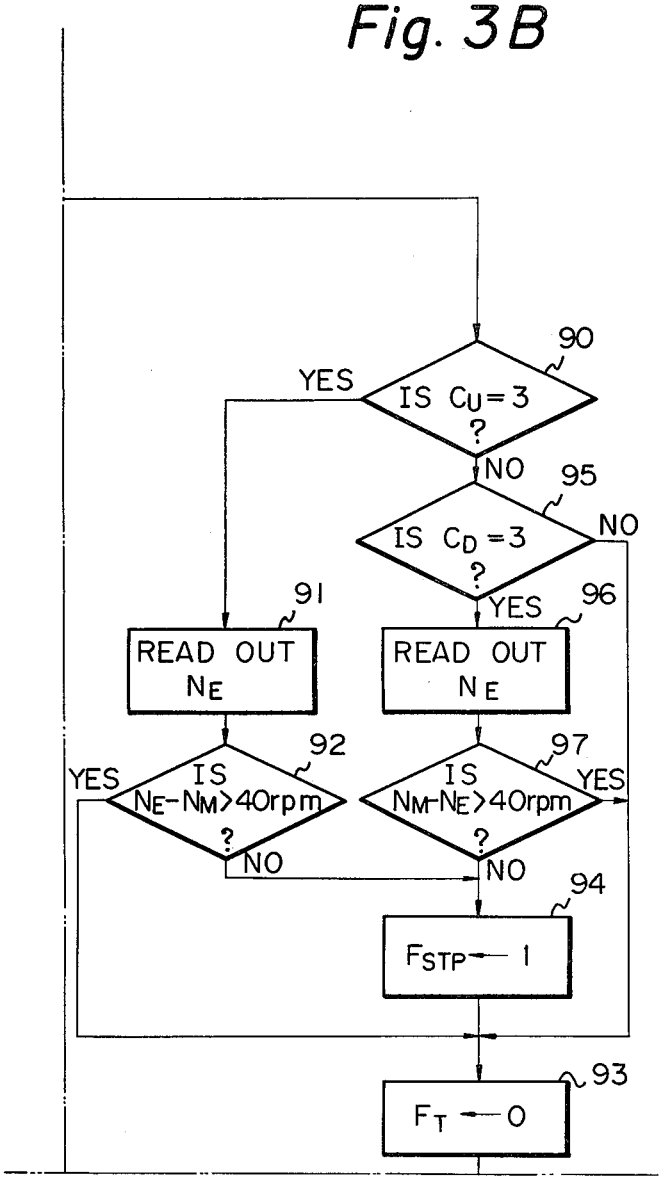
Figure 3C:
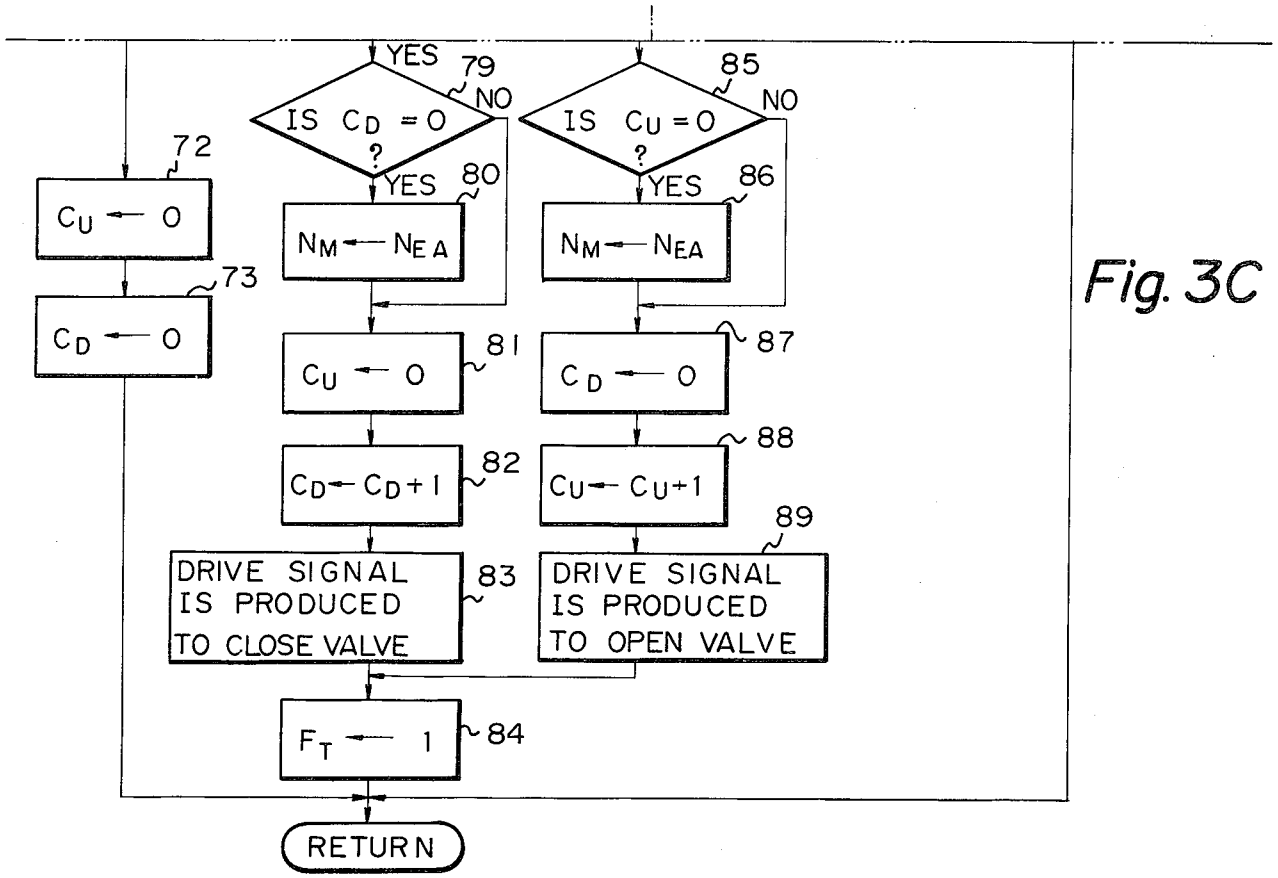

When it is so discriminated at the point 70 (FIG. 3A) that the timer flag $F_T$ is "1", the program proceeds to a point 90 (FIG. 3B). That is, when the interrupt processing routine of FIG. 3 is executed after T seconds from a time the valve-control motor (step motor) 20 was driven, the program proceeds to the point 90 because it is supposed that the engine speed will be stabilized.

At the point 90, the CPU 50 discriminates whether the content $C_U$ in the first counter is equal to "3" or not. If $C_U=3$, that is, if the valve-control motor 20 is continuously driven three times toward the same direction to open the valve, the program proceeds to a point 91.

At the point 91, the CPU 50 reads out the rotational speed signal which indicates the actual engine speed $N_E$ from the RAM 52. The rotational speed signal has been beforehand produced by the rotational speed signal generator 64 and stored in the RAM 52. Then, at a point 92, the CPU 50 discriminates whether or not the difference $(N_E-N_M)$ between the stored speed $N_M$ in RAM 52 and the above actual engine speed $N_E$ is greater than 40 rpm. As is mentioned before, if the system is correctly operated without malfunction, the engine speed will increase by 15 rpm when the valve-control motor 20 is turned by one time toward the direction to open the valve. Therefore, if the valve-control motor 20 is continuously turning three times toward the opening direction, the idle engine speed should be become $N_M+45$ rpm. Accordingly, if $N_E-N_M>40$ rpm, it is recognized that the closed-loop idle speed control system is correctly operated and thus the program proceeds to a point 93. At the point 93, the timer flag $F_T$ is inverted to "0", and, then, the interrupt processing routine of this time is thus finished.

Contrary to this, if $N_E-N_M\leqq 40$ rpm, that is, if the engine speed does not vary greater than 40 rpm although the valve-control motor 20 is continuously driven three times toward the opening direction, the program proceeds to a point 94. At the point 94, the stoppage flag $F_{STP}$ for inhibiting the idle speed control is set to "1". Thus, hereinafter the idle speed control operation is inhibited from being executed. Namely, when the closed-loop idle speed control system malfunctions, the idle speed control operation is inhibited from being executed.

On the other hand, if it is discriminated that $C_U\neq 3$ at the point 90, the program proceeds to a point 95. At the point 95, the CPU 50 discriminates whether the content $C_D$ in the second counter is equal to "3" or not. If $C_D=3$, that is, if the valve-control motor 20 is continuously driven three times toward the same direction to close the valve, the program proceeds to a point 96. If $C_D=3$, the program proceeds to the point 93.

At the point 96, the CPU 50 reads out the rotational speed signal indicating the actual engine speed $N_E$ from the RAM 52. Then, at a point 97, the CPU 50 discriminates whether or not the difference $(N_M-N_E)$ between the stored speed $N_M$ which was stored in RAM 52 at the point 80 and the actual engine speed $N_E$ is greater than 40 rpm.

If the closed-loop idle speed control system recognizes that the engine is in the predetermined idling condition because of a malfunction of the drive-shaft angle sensor 38 or the throttle position switch 28, and thus the idle speed control operation is executed, or if the throttle position switch 28 is a type which produces an idle position signal even when the throttle valve 14 opens by a certain extent and the throttle valve 14 is gradually opened, the engine speed will not decrease more than 40 rpm even if the valve-control motor 20 is continuously driven three times toward the same direction to close the control valve. Furthermore, if the closed-loop idle speed control system itself malfunctions, the same phenomenon will occur. Therefore, if $N_M - N_E \leqq 40$ rpm, the program proceeds to the point 94 so as to set the stoppage flag $F_{STP}$ to "1" whereby the idle speed control operation is inhibited from being executed.

Contrary to this, if $N_M - N_E > 40$ rpm, it is recognized that the correct idle speed control was carried out, and, thus, the program proceeds to the point 93.

The above embodiment of FIG. 2 has employed a step motor to drive the control valve 18. However, it is, of course, allowable to control the valve 18 by using a d-c servo motor instead of the valve control motor.

According to the above-mentioned embodiment, furthermore, the opening degree of the flow-control valve in the by-pass intake passage is adjusted to control the flow rate of the intake air when the engine is in the idling condition. The method of the present invention, however, can also be applied to an engine which does not have the by-pass intake passage and in which the closing position of the throttle valve is controlled to control the flow rate of the intake air when the engine is in the idling condition.

Figure 4:
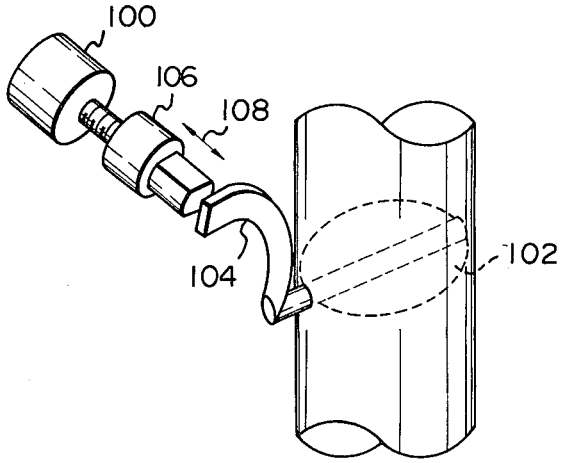
FIG. 4 is a perspective diagram illustrating another constitution of the idle air flow adjusting mechanism of the present invention.

FIG. 4 illustrates a setup for mechanically coupling the valve control motor 100 to the throttle valve 102 when the present invention is applied to engines of this type. Referring to FIG. 4, the tip of an arm 104, attached to the rotary shaft of the throttle valve 102, pushes the end surface of a linear actuator member 106. The end surface of the linear actuator member 106 serves as a stopper. As the motor 90 rotates, the linear actuator member 106 moves in the directions of the arrow 108. Therefore, the closing position of the throttle valve 102 or, in other words, the opening degree of the throttle valve when the engine is in the idling condition, is controlled responsive to the rotating amount of the motor 100. The rotating amount of the motor 100 can be easily converted into the movement of the linear actuator member 106 in the axial direction by, for example, forming a worm screw on the rotary shaft of the motor 100, and inserting the portion of worm screw into a threaded hole formed in the linear actuator member 106. This mechanism can also be adapted to the coupling between the control valve 18 and the motor 20 in the embodiment of FIG. 1. The setup, operation, functions and effects of a control unit for the motor 100 of the embodiment of FIG. 4 are quite the same as those of the above-mentioned embodiment.

According to the method of the present invention as illustrated in detail in the foregoing, when the idle speed control is executed due to a false predetermined idling condition, or when an abnormal idle speed control is executed owing to malfunction of the closed-loop control system, the idle speed control operation can be stopped. Therefore, abrupt decrease or abrupt change of the idle speed and also engine stall can be prevented before occurring.

As many widely different embodiments of the present invention may be constructed without departing from the spirit and scope of the present invention, it should be understood that the present invention is not limited to the specific embodiments described in this specification, except as defined in the appended claims.

We claim:

1. A method of controlling the idle rotational speed of an internal combustion engine including the steps of: detecting the rotational speed of the engine to produce an engine-speed signal which is determined depending upon the detected engine-speed; comparing said engine-speed signal with a reference signal which represents a desired idle speed of the engine to produce a control signal in accordance with the above comparison; increasing or decreasing the idle air flow to the engine in response to said control signal; and repeating the above sequence of steps so as to reduce the difference between said detected engine speed and said desired idle speed, wherein the improvement comprises the steps of:

discriminating whether or not the above increasing step of idle air flow is continuously repeated more than a predetermined number of times or the above decreasing step of idle air flow is continuously repeated more than a predetermined number of times;

if repeated more than the predetermined number of times, discriminating whether or not the variation of the engine speed during said repeated increasing or decreasing steps is less than a predetermined value; and if the engine-speed variation is less than the predetermined value, inhibiting the above control operation of the idle rotational speed from being executed.

2. A method as claimed in claim 1, wherein said rotational speed detecting step includes the steps of:

detecting the actual rotational speed of the engine; and calculating the average of the detected actual rotational speed to produce an engine-speed signal which indicates the average of the detected engine speed for a predetermined period of time.

3. A method as claimed in claim 1, wherein said variation discriminating step includes a step of discriminating whether or not the difference between an engine speed at a time when the repeating increment or decrement steps were initiated and a present engine-speed is less than a predetermined value.

4. A method as claimed in claim 1, wherein said increasing or decreasing step includes a step of increasing or decreasing, in response to said control signal, the sectional area of a bypass passage which communicates the intake passage at a position located upstream of the throttle valve with the intake passage at a position located downstream of the throttle valve.

5. A method as claimed in claim 1, wherein said increasing or decreasing step includes a step of changing, in response to said control signal, the closed position of the throttle valve.

* * * * *